US005269468A

United States Patent [19]

Adiutori

[11] Patent Number: 5,269,468

[45] Date of Patent: Dec. 14, 1993

[54] FUEL NOZZLE

[75] Inventor: Eugene F. Adiutori, West Chester, Ohio

[73] Assignee: General Electric Company, Cincinnati, Ohio

[21] Appl. No.: 902,263

[22] Filed: Jun. 22, 1992

[51] Int. Cl.[5] ..... B05B 15/00

[52] U.S. Cl. ..... 239/397.5; 239/132; 60/740

[58] Field of Search ..... 239/128, 132, 132.1, 239/132.3, 13, 397.5; 60/740, 742, 748

[56] References Cited

U.S. PATENT DOCUMENTS

| | | | |
|---|---|---|---|
| 2,546,937 | 3/1951 | Wyandt et al. | 239/128 |
| 2,857,204 | 10/1958 | Gross | 299/140 |
| 2,926,495 | 3/1960 | Benson et al. | 60/39.74 |
| 3,032,990 | 5/1962 | Rogers | 60/39.74 |
| 3,159,971 | 12/1964 | Moebius et al. | 60/740 |
| 3,638,865 | 2/1972 | McEneny et al. | 239/424 |
| 3,662,959 | 5/1972 | Sample, Jr. | 239/533.2 |
| 3,788,067 | 1/1974 | Carlisle et al. | 60/742 |
| 4,322,945 | 4/1982 | Peterson et al. | 60/39 |
| 4,467,610 | 8/1984 | Pearson et al. | 60/742 |
| 4,609,150 | 9/1986 | Pane, Jr. et al. | 239/397.5 |
| 4,638,636 | 1/1987 | Cohen | 60/741 |
| 4,898,329 | 2/1990 | Davis et al. | 239/13 |
| 4,934,145 | 6/1990 | Zeisser | 60/740 |

FOREIGN PATENT DOCUMENTS

| | | | |
|---|---|---|---|
| 2199648 | 7/1988 | United Kingdom | 60/742 |

*Primary Examiner*—Andres Kashnikow
*Assistant Examiner*—Christopher G. Trainor
*Attorney, Agent, or Firm*—Jerome C. Squillaro; James P. Davidson

[57] ABSTRACT

A fuel nozzle having increased thermal resistance which eliminates or minimizes vaporization of fuel passing through the fuel nozzle. The fuel nozzle has a tubular heat shield which surrounds a nozzle stem to form an air gap between the nozzle stem and the heat shield. A radiation layer is located on an inner wall of the heat shield and an outer wall of the nozzle stem. The radiation layer is a layer or plating using a metal having a low emissivity, such as gold (Au).

5 Claims, 1 Drawing Sheet

FUEL NOZZLE

BACKGROUND OF THE INVENTION

1. Field of the Invention

This invention relates to a fuel nozzle and, more particularly, to a fuel nozzle having improved thermal resistance for eliminating or minimizing vaporization of fuel passing through the fuel nozzle.

2. Description of Related Art

Gas turbine engines commonly comprise a fuel nozzle for delivering fuel from a fuel supply source to an engine combustion apparatus.

It is not uncommon that the temperatures around the fuel nozzle can exceed 1000° F. The presence of high temperatures around the fuel nozzle can cause the fuel passing through an inner passageway of the fuel nozzle to form granules of carbon on the walls of the inner passageway. The carbon formation on the walls of the inner passageway may cause the fuel nozzle to become clogged. Excessive temperatures can also cause the fuel in the fuel nozzle to gum up, thereby further causing the fuel nozzle to become clogged. In addition, when the temperature of the fuel reaches approximately 300° F., the fuel may begin to vaporize in the inner passageway, thereby resulting in intermittent or non-continuous fuel delivery to the downstream end of the fuel nozzle.

Conventional fuel nozzles typically comprise a heat shield which surrounds a nozzle stem of the fuel nozzle and which cooperates with the nozzle stem to define an annular air gap which surrounds the nozzle stem. The purpose of the heat shield and air gap is to insulate the fuel nozzle from the high temperatures.

Although fuel nozzles have been provided with heat shields, the heat shield design may not be adequate to prevent vaporization of the fuel and the other problems mentioned above.

SUMMARY OF THE INVENTION

It is therefore an object of the present invention to provide a fuel nozzle having improved means for insulating a nozzle stem of the fuel nozzle by reflecting heat away from the fuel stem.

Another object of this invention is to provide a fuel nozzle which has improved insulation characteristics such that vaporization of fuel is either substantially reduced or eliminated.

Still another object of this invention is to provide a fuel nozzle having a heat shield which cooperates with a stem on the fuel nozzle to define an annular air gap and which also comprises a radiating shield for improving the thermal resistance of the fuel nozzle.

In one aspect of the invention, this invention comprises a fuel nozzle for use in a gas turbine engine, said fuel nozzle comprising a nozzle stem having an upstream end and a downstream end and also having at least one fuel passageway therethrough for permitting fuel to pass from said upstream end to said downstream end; a heat shield associated with said nozzle stem for shielding said nozzle stem from heat, said nozzle stem and said heat shield defining an air gap surrounding said nozzle stem; and a radiation shield associated with said air gap, said radiation shield minimizing the temperature rise of said fuel.

An advantage of this invention is that it is simple and inexpensive to use.

Another advantage of this invention is that by minimizing the temperature rise of the fuel in the nozzle stem, the heat sink potential of the fuel is maximized which facilitates using the fuel as a coolant at locations upstream of the fuel nozzle.

These objects, advantages, and others, may be more readily understood in connection with the following specification, claims and drawing.

DESCRIPTION OF THE PREFERRED EMBODIMENT

Figure 1:
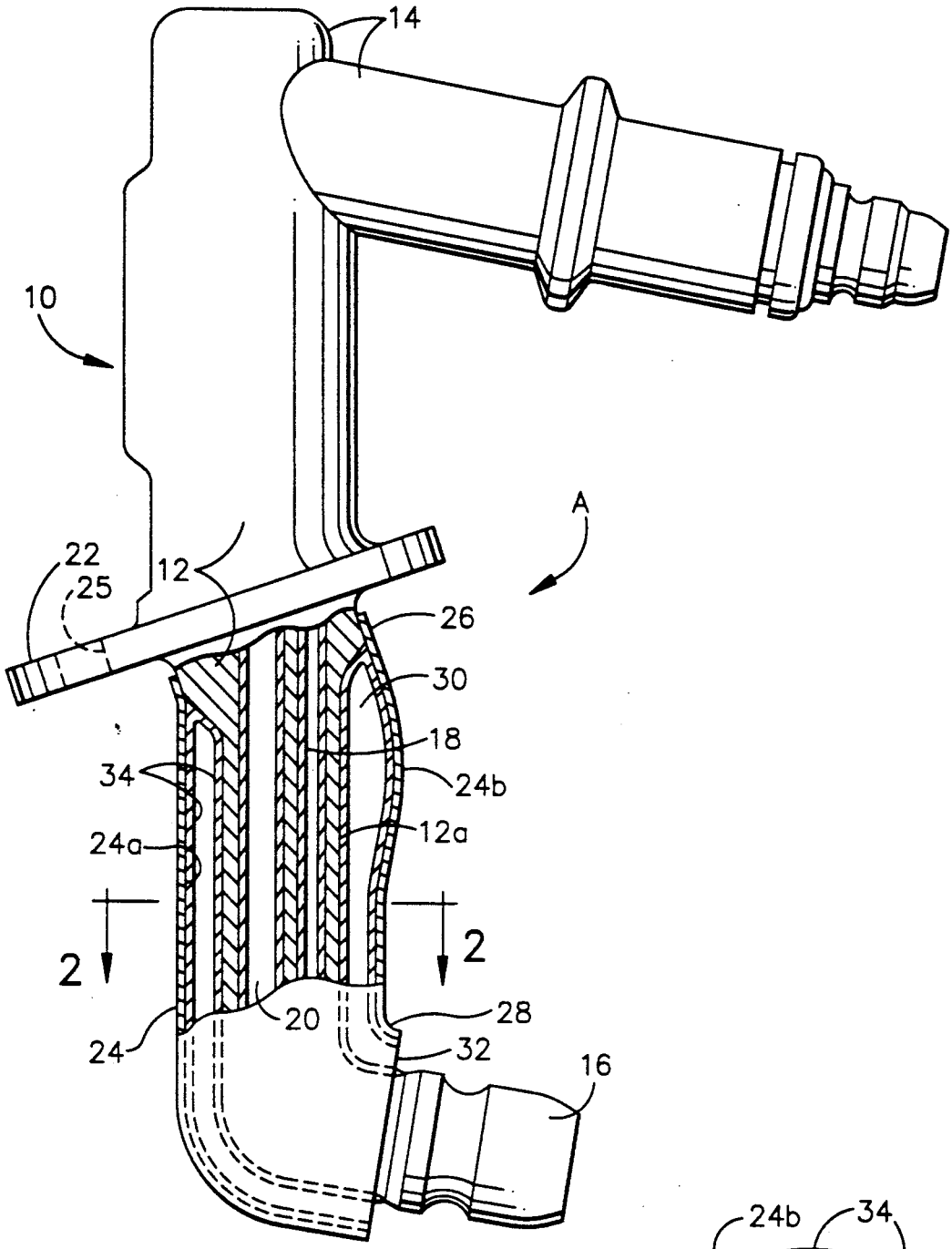
FIG. 1 is a fragmentary view of a fuel nozzle showing a primary fuel passageway, secondary fuel passageway, heat shield, air gap and radiating shield.

FIG. 1 is a fragmentary view of a preferred embodiment of this invention, designated generally as fuel nozzle 10, for use in a gas turbine engine (not shown). The fuel nozzle 10 comprises a nozzle stem 12 which is generally U-shaped and which has an upstream end 14 and a downstream end 16. The nozzle stem 12 also comprises a mounting bracket 22 integrally formed as part of nozzle stem 12. The mounting bracket 22 comprises an aperture 25 for mounting the fuel nozzle 10 to a combustor apparatus (not shown). In the embodiment being described, upstream end 14 is coupled to a supply source of fuel (not shown) and downstream end 16 is positioned in operative relationship with a combustor dome assembly (not shown) of the combustor apparatus.

Figure 2:
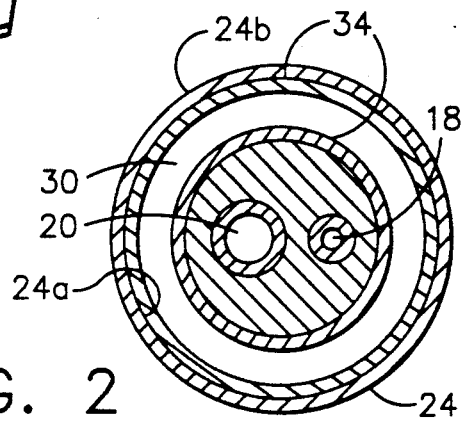
FIG. 2 is a cross-sectional view, taken along the line 2—2 in FIG. 1, showing more details of the air gap and radiation shield shown in FIG. 1.

The fuel nozzle 10 also comprises a tubular heat shield 24 having a first end 26 which is conventionally coupled (for example, by a weld or braze) towards upstream end 14 of nozzle stem 12 as shown. The tubular heat shield 24 also comprises a second end 28 which is operatively associated with downstream end 16. As illustrated in FIGS. 1 and 2, tubular heat shield 24 is generally cylindrical in shape and surrounds nozzle stem 12. As best illustrated in FIG. 1, nozzle stem 12 comprises an outer surface **12*a* which cooperates with an inner surface 24*a* of heat shield 24 to define an annular air gap 30 about nozzle stem 12. It is to be noted that second end 28 of heat shield 24 cooperates with downstream end 16 to define an annular opening 32 which opens into air passageway 30 in order to permit air or other gases (not shown) to pass into and out of air gap 30**.

The fuel nozzle 10 also comprises means associated with annular air gap 30 for further insulating nozzle stem 12 in order to minimize the temperature rise of the jet fuel passing through primary and secondary passages 18 and 20 and also to prevent the temperature of the jet fuel from exceeding a predetermined temperature. In the embodiment being described, the predetermined temperature is less than 400° F.

The means comprises a radiation shield 34 which is a metallic alloy plating having a thickness of 10–50 millionths of an inch. In the embodiment being described, the radiation shield 34 is a gold (AU) plating which is applied to outer surface **12*a* and inner surface 24*a* by conventional electroplating techniques. Although FIG. 1 shows radiation shield 34 applied to both outer surface 12*a* and inner surface 24*a*, it should be appreciated that radiation shield 34 could be located on only outer surface 24*a* or only inner surface 12*a* if desired. Further-more, although radiation shield 34 has been described herein as being a gold plating, it should be appreciated that radiation shield 34 could be a plating using any type of metal which has a low emissivity or an emissivity of less than approximately 0.1. It should be appreciated that gold has an emissivity of 0.02. In the embodiment being described, heat shield 24 is made of stainless steel, and nozzle stem 12 is made of 347 stainless steel or inco 625 which is available from Parker-Hannifin Corporation. The stainless steel heat shield has a normal emissivity of 0.80. By applying radiation shield 34 to outer surface 12***a* and inner surface 24*a*, for example, the radiation heat flow is reduced by approximately 98%.

Advantageously, the nozzle stem 12 is insulated so that heat is radiated away from nozzle stem 12. Fuel (not shown) passing from upstream end 14 through primary and secondary fuel passageways 18 and 20 to downstream end 16 does not vaporize in the primary and secondary fuel passageways 18 and 20 before being discharged out of downstream end 16.

Various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

I claim:

1. A fuel nozzle for use in a gas turbine engine, said fuel nozzle comprising:

(a) a nozzle stem having an upstream end and a downstream end and also having at least one fuel passageway therethrough for permitting fuel to pass from said upstream end to said downstream end;

(b) a heat shield associated with said nozzle stem for shielding said nozzle stem from heat, said nozzle stem and said heat shield defining an air gap surrounding said nozzle stem; and (c) a radiation shield associated with said air gap having an emissivity of less than 0.1, said radiation shield minimizing the temperature rise of said fuel.

2. The fuel nozzle of claim 1, wherein said nozzle stem comprises an outer surface and said heat shield comprises an inner surface, said outer and inner surfaces defining said air gap, said radiation shield being located on at least one of said outer or inner surfaces.

3. The fuel nozzle of claim 2, wherein said radiation shield is a metallic alloy plating having a thickness of about 10–50 millionths of an inch.

4. The fuel nozzle of claim 3, wherein said metallic alloy plating is Au.

5. A fuel nozzle for use in a gas turbine engine, said fuel nozzle comprising:

(a) a nozzle stem having an upstream end and a downstream end and also having at least one fuel passageway therethrough for permitting fuel to pass from said upstream end to said downstream end;

(b) a heat shield associated with said nozzle stem for shielding said nozzle stem from heat, said nozzle stem and said heat shield defining an air gap surrounding said nozzle stem, wherein said air gap is annular, said heat shield being circular in cross-section and surrounding said nozzle stem and having a first end and a second end, said first end being secured to said upstream end of said fuel nozzle, and said second end cooperating with said downstream end of said nozzle stem to form an annular opening for permitting air to pass into and out of said air gap; and (c) a radiation shield associated with said air gap, said radiation shield minimizing the temperature rise of said fuel.

* * * * *